US009953816B2

(12) United States Patent
Hoyes et al.

(10) Patent No.: US 9,953,816 B2
(45) Date of Patent: Apr. 24, 2018

(54) MULTIPLE CHANNEL DETECTION FOR TIME OF FLIGHT MASS SPECTROMETER

(71) Applicant: Micromass UK Limited, Wilmslow (GB)

(72) Inventors: John Brian Hoyes, Stockport (GB); Anthony James Gilbert, High Peak (GB); Motohiro Suyama, Shizuoka (JP)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

(21) Appl. No.: 14/519,754

(22) Filed: Oct. 21, 2014

(65) Prior Publication Data

US 2015/0034819 A1 Feb. 5, 2015

Related U.S. Application Data

(63) Continuation of application No. 14/348,130, filed as application No. PCT/GB2012/052415 on Sep. 28, 2012, now Pat. No. 8,884,220.

(30) Foreign Application Priority Data

Sep. 30, 2011 (GB) ..... 1116845.7

(51) Int. Cl.
*H01J 49/02* (2006.01)
*H01J 49/40* (2006.01)
*H01J 49/00* (2006.01)

(52) U.S. Cl.
CPC ..... *H01J 49/025* (2013.01); *H01J 49/0031* (2013.01); *H01J 49/40* (2013.01)

(58) Field of Classification Search
USPC ..... 250/287
See application file for complete search history.

(56) References Cited

U.S. PATENT DOCUMENTS 5,326,978 A 7/1994 Aebi et al.
5,572,022 A * 11/1996 Schwartz ..... H01J 49/4265 250/282
5,777,326 A 7/1998 Rockwood et al.
6,958,474 B2 * 10/2005 Laprade ..... H01J 43/246 250/287

(Continued)

FOREIGN PATENT DOCUMENTS

JP 2004355884 12/2004
JP 2005134374 5/2005

(Continued)

OTHER PUBLICATIONS

Agata et al., "*Silicon Photodiodes for High-Efficiency Low-Energy Electron Detection*", Proceedings of the European Solid-State Device Research Conference, pp. 102-105, 2010.

(Continued)

*Primary Examiner* — Phillip A Johnston

(57) ABSTRACT

An ion detector for a Time of Flight mass spectrometer is disclosed comprising a single Microchannel Plate which is arranged to receive ions and output electrons. The electrons are directed onto an array of photodiodes which directly detects the electrons. The output from each photodiode is connected to a separate Time to Digital Converter provided on an ASIC.

22 Claims, 6 Drawing Sheets

(56) References Cited

U.S. PATENT DOCUMENTS

| | | | | |
|---|---|---|---|---|
| 7,012,248 | B2 * | 3/2006 | Paschalidis | 250/287 |
| 7,084,393 | B2 | 8/2006 | Fuhrer et al. | |
| 7,265,346 | B2 * | 9/2007 | Whitehouse | H01J 49/025 250/281 |
| 7,482,883 | B2 * | 1/2009 | Staszewski | H03L 7/085 331/182 |
| 8,389,929 | B2 | 3/2013 | Schoen et al. | |
| 8,492,710 | B2 | 7/2013 | Fuhrer et al. | |
| 8,680,481 | B2 | 3/2014 | Giannakopulos et al. | |
| 2003/0111597 | A1 | 6/2003 | Gonin et al. | |
| 2011/0049355 | A1 | 3/2011 | Fuhrer et al. | |

FOREIGN PATENT DOCUMENTS

| | | |
|---|---|---|
| JP | 2005302622 | 10/2005 |
| JP | 2007242252 | 9/2007 |

OTHER PUBLICATIONS

Birch et al., "*Probe Design and Chemical Sensing* (*Multiwavelength Array Detection*)", Topics in Fluorescence Spectroscopy, vol. 4, pp. 386, 2002.

"*Characteristics of a Multichannel Electrooptical Detection System and its Application to the Analysis of Large Molecules by Fast Atom Bombardment Mass Spectrometry*", Analytical Chemistry, vol. 59, No. 15, pp. 1990-1995, 1987.

Chistokhin et al., "*Silicon Avalanche Diodes for Direct Detection of Nuclear Particles*", Micro/Nanotechnologies and Electron Devices, pp. 359-362, 2009.

Gross, "*Mass Spectrometry—A Textbook Passage* (*Detectors*)", Mass Spectrometry—A Textbook, pp. 207, 2011.

Johnson et al., "*Electron Bombarded Silicon Avalanche Diode PMT Development*", Proceedings SPIE, vol. 1952, pp. 345-349, 1993.

Shunji, "*Si-APD Detectors for Nuclear Excitation Experiments*", APD Detectors Workshop, pp. 1-22, 2005.

Susumu et al., "*Study of 144-Channel Hybrid Avalanche Photo-Detector for Belle II RICH Counter*", Nuclear Instruments and Methods in Physics Research, vol. 628, No. 1, pp. 315-318.

Taylor et al., "*Improved Detection Limits in an Organic Mass Spectrometer Using a Combination of Matrix Free FAB and Photodiode Array Detection*", Biochemical and Biophysical Research Communications, vol. 145, No. 1, pp. 542-548, 1987.

Gethyn, "*Electronic Readout Systems for Microchannel Plates*", IEEE Transactions on Nuclear Science, vol. 32, No. 1, pp. 427-432, 1985.

J. Gethyn Timothy, "Electronic Readout System for Microchannel Plates", IEEE Transactions on Nuclear Science, vol. NS-32, No. 1, Feb. 1985.

Miller, M. K. "*Concepts in atom probe designs*", Surface Science, vol. 246, No. 1-3, pp. 428-433, 1991.

Steffens, P. "*A time-of-flight mass spectrometer for static SIMS applications*", J. Vac. Sci. Technol., vol. 3, No. 3, pp. 1322-1325, 1985.

* cited by examiner

Simple threshold trigger Level $V_{th}$

Triggering with CFD

MULTIPLE CHANNEL DETECTION FOR TIME OF FLIGHT MASS SPECTROMETER

CROSS-REFERENCE TO RELATED APPLICATION

This application is a continuation application of U.S. application Ser. No. 14/348,130, filed 28 Mar. 2014 which is the National Stage of International Application No. PCT/GB2012/052415, filed 28 Sep. 2012, which claims priority from and the benefit of United Kingdom Patent Application No. 1116845.7 filed on 30 Sep. 2011. The entire content of this application is incorporated herein by reference.

BACKGROUND TO THE PRESENT INVENTION

The present invention relates to an ion detector for a Time of Flight mass spectrometer, a Time of Flight mass analyser, a mass spectrometer, a method of detecting ions and a method of mass spectrometry. Time of Flight mass spectrometers comprising an ion detector coupled to a one bit Time to Digital Converter ("TDC") are well known. Signals resulting from ions arriving at the ion detector which satisfy defined detection criteria are recorded as single binary values associated at a particular arrival time relative to a trigger event.

It is known to use a fixed amplitude threshold to trigger recording of an ion arrival event. Ion arrivals recorded for subsequent trigger events are added to a histogram of events which is then presented as a spectrum for further processing. TDCs allow efficient detection of weak signals where the probability of multiple ions arriving in close temporal proximity is relatively low. However, once an ion event has been recorded then there is a significant time interval ("dead time") following the event during which time no further events may be recorded.

A disadvantage of the known ion detector with a one bit TDC detector is its inability to distinguish between a signal arising from the arrival of a single ion and a signal arising from the arrival of multiple ions at the same time since the resulting signal only crosses the threshold once irrespective of whether a single ion arrives or multiple ions arrive. As a result, both of these situations result in only one event being recorded.

At high signal intensities the problem of being unable to discriminate between a single ion arrival event and multiple ions arriving, together with the problem of dead time effects results in some ion arrival events not being recorded or the actual number of ions being incorrectly recorded. This results in an inaccurate representation of the signal intensity and also results in an inaccurate measurement of the arrival time. These effects place an effective limit on the dynamic range of the detector system.

More recent commercial Time of Flight mass spectrometers have moved away from using TDC detector systems and utilise instead an Analogue to Digital Converter ("ADC") based detector system.

ADCs operate by digitising a signal output from an ion detector relative to a trigger event. The digitized signal from subsequent trigger events may be summed or averaged to produce a spectrum for further processing. State of the art signal averagers are capable of digitizing the output of detector electronics at 4 or 6 GHz with eight, ten or twelve bit intensity resolution.

Using an ADC detector advantageously allows multiple ion arrivals to be recorded at relatively high signal intensities without the detector suffering from distortion.

Whilst current state of the art ADC detector systems have several advantages over earlier TDC detector systems, ADC detector systems suffer from the problem that detection of low intensity signals is generally limited by electronic noise from the digitiser electronics, detector and amplifier used. This effect limits the dynamic range of ADC detection systems. Another disadvantage of a conventional ADC detector compared with a TDC detector is that the analogue width of the signal generated by a single ion adds to the width of the ion arrival envelope for a particular mass to charge ratio value in the final spectrum.

The ability of a mass spectrometer to detect a low level species in the presence of or close proximity of another species at high level is known as the abundance sensitivity. Abundance sensitivity may be defined as the ratio of the maximum ion current recorded at a mass m to the ion current arising from the same species recorded at an adjacent mass (m+1).

Single channel ADC systems have limited abundance sensitivity because mismatch of the high frequency detector impedance causes ringing after a large ion signal. The level and duration of the ringing obscures low level signals arriving after a large peak and so low level ion signals can go undetected.

FIG. 1A shows an ion signal having a $\lambda$ of 10 (wherein $\lambda$ corresponds with the number of ions per push per peak). FIG. 1B shows an artifact which is typically observed in an ADC detector system following the arrival of an intense ion beam. The artifact is a time delayed image of the signal. FIG. 1C shows how a threshold set at $\lambda$ equal to 1 can discriminate between a real small signal and an artifact of a large signal having a $\lambda$ of 10. FIG. 1D illustrates a problem with current state of the art ADC detector systems. The threshold is set at $\lambda$ equal to 1 and is effective in discriminating between a real small signal and an artifact of a large signal having a $\lambda$ of 10. However, the threshold is not able to discriminate an artifact of a very large signal having a $\lambda$ of 20.

As will therefore be readily appreciated by those skilled in the art, current commercial Time of Flight mass spectrometers employing ADC ion detectors suffer from the problem of having a limited abundance sensitivity. Consideration has therefore been given as to how to improve the abundance sensitivity of commercial Time of Flight mass analysers.

One attempt at improving the abundance sensitivity of a Time of Flight mass analyser is to revert to using a TDC based detector system. According to a known arrangement a double or chevron Micro Channel Plate ("MCP") ion detector may be used to detect ions and convert the ions to electrons. The electrons are then detected using multiple metal anodes each of which is connected to an individual TDC. The use of multiple anodes reduces the problem of deadtime effects and the inability to distinguish between multiple ions arriving at substantially the same time and a single ion arrival event since multiple ions arriving at substantially the same time are likely to be detected by different anodes.

The known approach using TDCs and multiple anodes effectively comprises a multiple pixel detection scheme which splits an ion signal into many channels. It is important that an individual ion strike should ultimately illuminate only a single pixel on the detector to take advantage of the increase in dynamic range that multiple detector channels afford. A double or chevron MCP arrangement is used because it retains the spatial information of the original ion strike with little signal flaring such that the output electron cloud only illuminates a single pixel or anode. Additionally, in a chevron configuration, the double or chevron MCP has enough gain to be amenable to simple amplification that can then trigger a threshold in a TDC system. Splitting the signal into many channels ensures that each anode receives a lower average ion count and a low level signal can be detected without interference from a high level signal thereby improving the abundance sensitivity characteristic.

However, despite certain advantages in using a detector arrangement comprising a double MCP, multiple anodes and multiple TDCs, such an arrangement remains only effective at detecting an ion signal at relatively low or moderate ion intensities.

As will be appreciated by those skilled in the art, ion sources are being developed which are becoming increasingly brighter and state of the art and future ion detectors need to be able to operate at high ion currents. However, the known multiple anode and multiple TDC ion detector arrangement is unable to provide sufficient gain for the detector electronics to function at high ion currents (i.e. $>10^7$ events/second). Furthermore, the known detector arrangement also suffers from the problem of crosstalk between the metallic anodes which degrades the performance of the ion detector.

ADC based ion detector systems are also unable to operate with very bright ion sources i.e. $>10^7$ events/second. Furthermore, ADC detector systems suffer from the problem of limited abundance sensitivity due to the effects of ringing after a large ion signal as discussed above.

It is therefore desired to provide an improved detector system for a Time of Flight mass spectrometer which is capable of processing e.g. $10^9$ events/second and which does not suffer from the problems inherent with both known ADC and TDC detector systems.

SUMMARY OF THE PRESENT INVENTION

According to an aspect of the present invention there is provided an ion detector for a Time of Flight mass spectrometer comprising:

- a first device arranged and adapted to receive ions and output electrons;
- an array of photodiodes arranged and adapted to detect either the electrons or photons, each photodiode having an output; and
- an array of Time to Digital Converters wherein the output from each photodiode is connected to a separate Time to Digital Converter.

The first device preferably comprises a single or double microchannel plate.

The ion detector preferably further comprises a device arranged and adapted to accelerate electrons emitted from the first device so that the electrons preferably possess a kinetic energy of <1 keV, 1-2 keV, 2-3 keV, 3-4 keV, 4-5 keV, 5-6 keV, 6-7 keV, 7-8 keV, 8-9 keV, 9-10 keV or >10 keV upon impinging upon the array of photodiodes.

The array of photodiodes preferably comprises at least 10, 20, 30, 40, 50, 60, 70, 80, 90, 100, 150, 200, 250, 300, 350, 400, 450, 500, 550, 600, 650, 700, 750, 800, 850, 900, 950, 1000, 1100, 1200, 1300, 1400, 1500, 1600, 1700, 1800, 1900 or 2000 photodiodes.

The photodiodes preferably comprise silicon photodiodes.

The photodiodes are preferably arranged and adapted to directly detect electrons.

The photodiodes are preferably arranged and adapted to create electron-hole pairs.

The array of Time to Digital Converters preferably comprises at least 10, 20, 30, 40, 50, 60, 70, 80, 90, 100, 150, 200, 250, 300, 350, 400, 450, 500, 550, 600, 650, 700, 750, 800, 850, 900, 950, 1000, 1100, 1200, 1300, 1400, 1500, 1600, 1700, 1800, 1900 or 2000 Time to Digital Converters.

The ion detector preferably further comprises a separate discriminator connected to each output from the photodiodes.

The discriminators or at least some of the discriminators preferably comprise Constant Fraction Discriminators ("CFDs").

The discriminators or at least some of the discriminators may alternatively comprise leading edge or zero crossing discriminators.

The ion detector preferably further comprises a second device arranged and adapted to provide a magnetic and/or electric field which directs the electrons onto the array of photodiodes.

The array of Time to Digital Converters and optionally a plurality of discriminators are preferably provided on an Application Specific Integrated Circuit ("ASIC").

The ion detector preferably further comprises a Field Programmable Gate Array ("FPGA") and optionally an optical fibre data link arranged between the Application Specific Integrated Circuit and the Field Programmable Gate Array.

The Field Programmable Gate Array is preferably maintained substantially at ground or zero potential.

The ion detector preferably further comprises a converter arranged and adapted to receive ions and output photons.

The converter preferably comprises a scintillator.

The converter is preferably arranged between the first device and the array of photodiodes.

The array of photodiodes is preferably arranged and adapted to detect photons output from the converter or other photons.

The ion detector preferably further comprises a third device arranged and adapted to provide a magnetic and/or electric field which directs the electrons onto the converter.

The ion detector preferably further comprises a fibre optic plate, lens or photon guide arranged between the converter and the array of photodiodes, wherein the fibre optic plate, lens or photon guide transmits or guides the photons or other photons towards the array of photodiodes.

The Application Specific Integrated Circuit is preferably maintained substantially at ground or zero potential.

The ion detector is preferably arranged and adapted to process $\geq 10^7$, $\geq 10^8$ or $\geq 10^9$ events per second.

According to an aspect of the present invention there is provided a Time of Flight mass analyser comprising an ion detector as described above.

According to an aspect of the present invention there is provided a mass spectrometer comprising an ion detector as described above or a Time of Flight mass analyser as described above.

According to an aspect of the present invention there is provided a method of detecting ions from a Time of Flight mass spectrometer comprising:

- receiving ions and outputting electrons;
- detecting either the electrons or photons using an array of photodiodes, each photodiode having an output; and
- passing the output from each photodiode to a separate Time to Digital Converter.

According to an aspect of the present invention there is provided a method of mass spectrometry comprising a method as described above.

The ion detector according to the preferred embodiment is particularly suited to operating with state of the art and next generation bright ion sources in that the preferred ion detector is preferably capable of processing $10^9$ ion arrival events/second. This represents a two order of magnitude increase over current state of the art detector systems.

Furthermore, the ion detector according to the preferred embodiment of the present invention is particularly advantageous in that it has a significantly improved abundance sensitivity compared with state of the art ADC ion detectors and does not suffer from the problem of cross talk which is problematic for multiple anode TDC ion detectors.

The ion detector according to the preferred embodiment therefore represents a significant advance in the art.

According to the preferred embodiment a single MCP plate is preferably used in conjunction with a photodiode array. The photodiode array is preferably used to directly detect electrons emitted from the MCP. However, other embodiments are contemplated wherein the electrons emitted from the MCP may be converted into photons and the photons may then be detected by a photodiode array.

The single MCP plate and the photodiode array in combination preferably provide an overall gain of $10^6$. According to an embodiment the photodiode array may comprise, for example, 1000 or more photodiodes each of which is preferably connected to a separate TDC. Overall the detector system is preferably able to detect $10^9$ ion arrival events/second.

The electron cloud emanating from the MCP output due to each individual ion strike is preferably accelerated onto the surface of an individual photodiode which is part of a photodiode array. The electrons are preferably of sufficient energy to amplify the signal by a factor of around 1000 or greater. The signal is then preferably further amplified and time stamped.

The preferred embodiment allows an improvement in dynamic range and abundance sensitivity characteristic over conventional ion detectors.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; and (xxi) an Impactor spray ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) one or more energy analysers or electrostatic energy analysers; and/or (h) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wein filter; and/or (i) a device or ion gate for pulsing ions; and/or (j) a device for converting a substantially continuous ion beam into a pulsed ion beam.

The mass spectrometer may further comprise a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

BRIEF DESCRIPTION OF THE DRAWINGS

Various embodiments of the present invention together with other arrangements given for illustrative purposes only will now be described, by way of example only, and with reference to the accompanying drawings in which:

FIG. 1C shows how a threshold set at $\lambda=1$ can discriminate between a real small signal and an artifact of a large signal having a $\lambda=10$ and FIG. 10 shows how a threshold set at $\lambda=1$ is effective in discriminating between a real small signal and an artifact of a large signal having a $\lambda=10$ but is unable to discriminate an artifact of a very large signal having a $\lambda=20$;

DETAILED DESCRIPTION OF PREFERRED EMBODIMENTS

A known ion detector comprises a chevron arrangement of two Micro Channel Plates ("MCPs") and a metallic anode detector. The two MCPs provide coulombic gains of $10^6$ or more before digitization. Such an arrangement is effective in amplifying signals in an ion detector of a Time of Flight mass spectrometer up to an incoming ion rate of about $10^7$ events/second. However, if the incoming ion rate increases above about $10^7$ events/second then the double MCP arrangement becomes non linear as it is no longer possible to sustain the strip current required to maintain its gain.

Figure 1A:
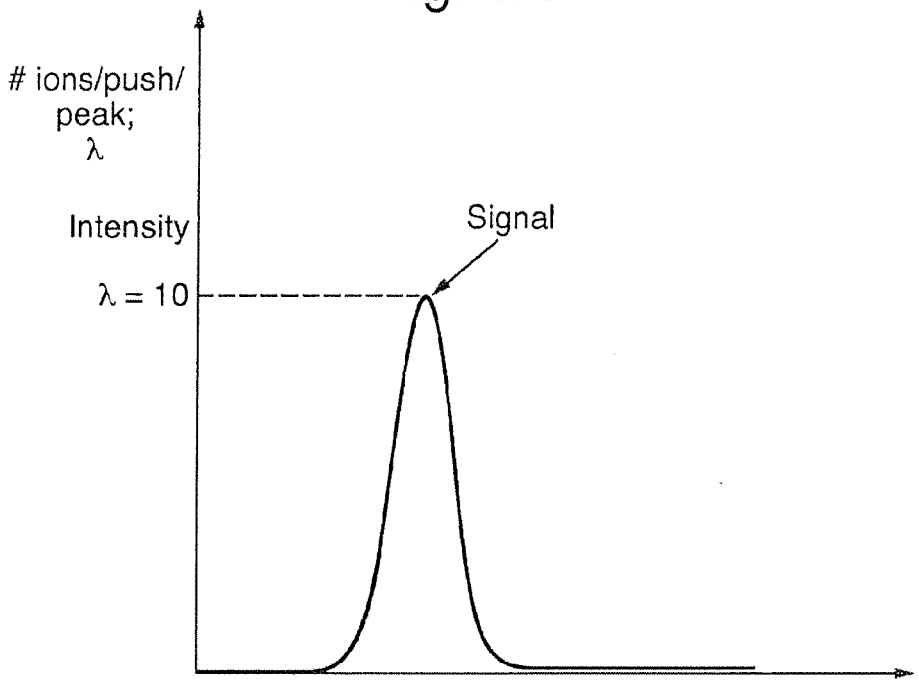
FIG. 1A shows an ion signal corresponding to 10 ions per push per peak.
Figure 1B:
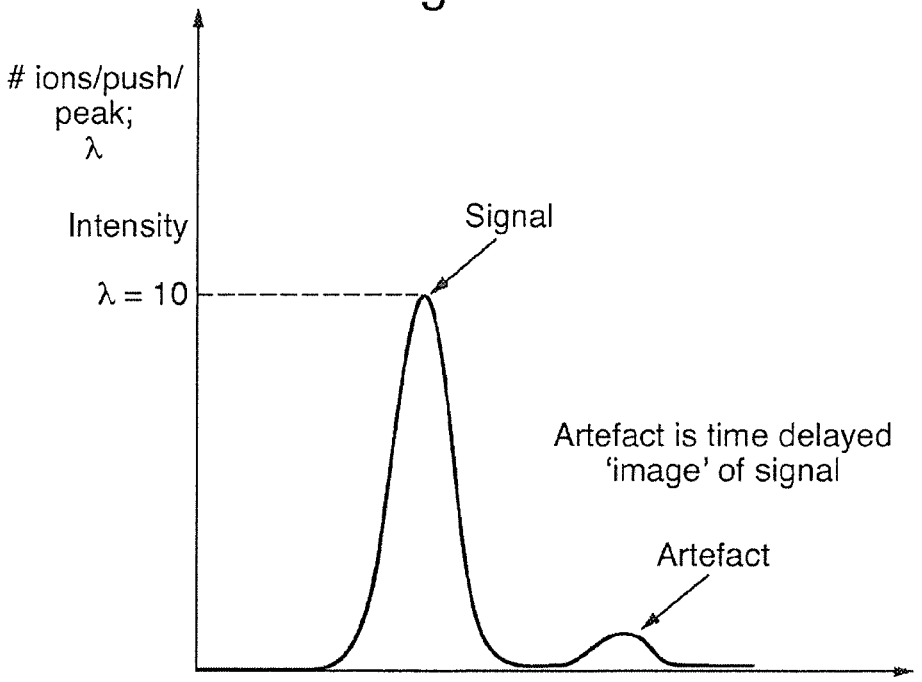
FIG. 1B shows an artifact which is typically observed in ADC detector systems following the arrival of an intense ion beam.
Figure 1C:
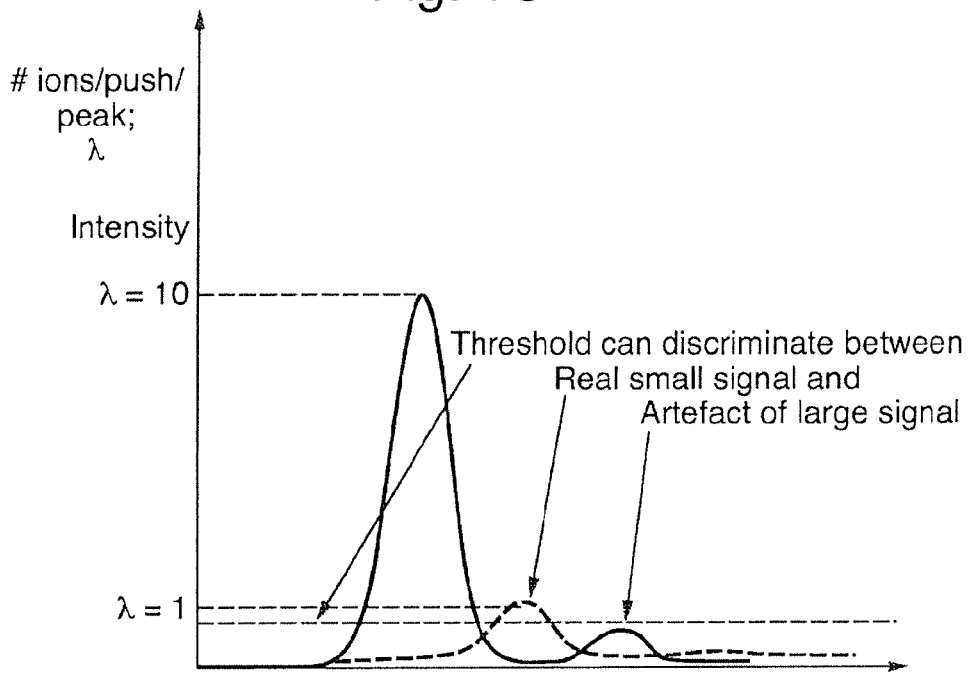
Figure 1D:
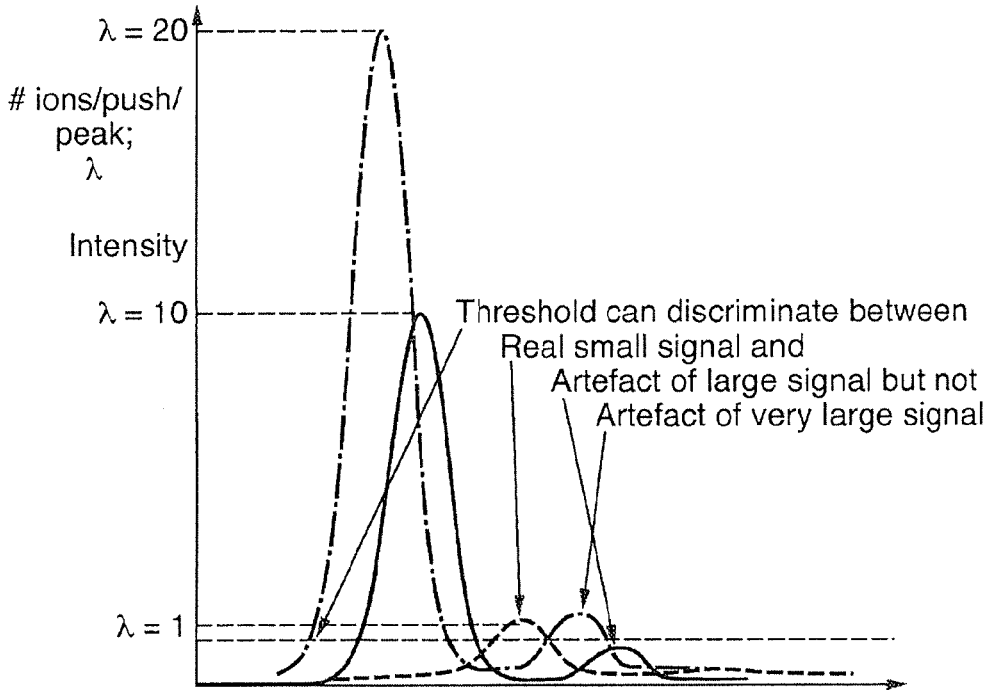
Figure 2:
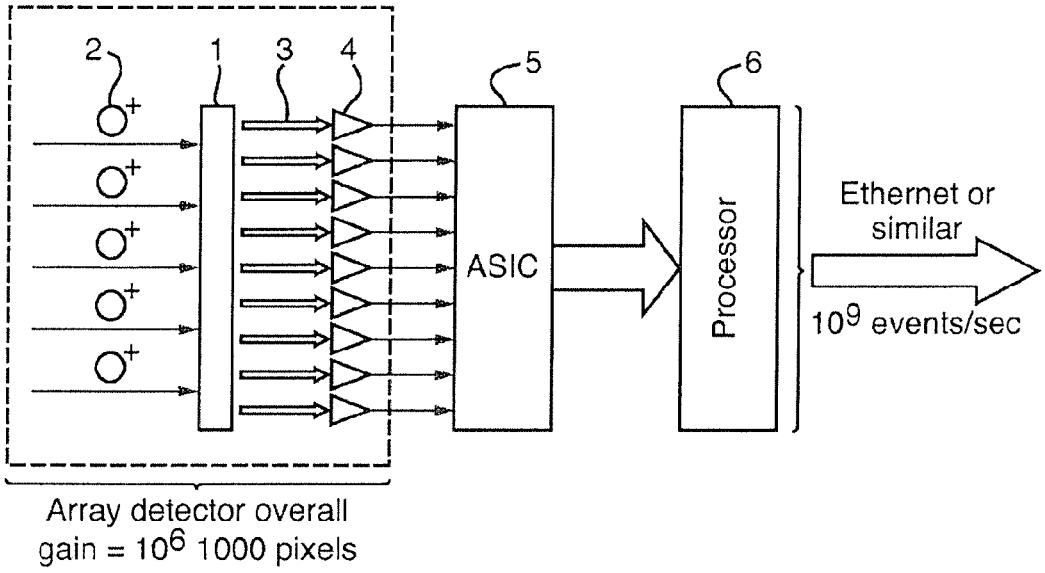
FIG. 2 shows a photodiode array detection system for a Time of Flight mass spectrometer according to an embodiment of the present invention.

FIG. 2 shows an ion detector according to a preferred embodiment of the present invention. The ion detector preferably comprises a single MCP detector 1. Ions 2 impinge upon the front face of the single MCP detector 1 which results in a cascade of electrons 3 being emitted from the rear face of the MCP detector 1. The electrons 3 are directed onto an array of silicon photodiodes 4. Each photodiode 4 in the photodiode array is preferably connected to a discriminator and a separate TDC. The array of discriminators and TDCs is preferably provided on an Application Specific Integrated Circuit ("ASIC") 5.

According to an embodiment the photodiode array may comprise 1000 or more photodiodes 4. Accordingly, the ASIC 5 preferably comprises a corresponding array of 1000 or more discriminators each connected to an individual TDC (i.e. the ASIC 5 preferably comprises 1000 or more discriminators and 1000 or more TDCs).

According to the preferred embodiment the discriminators comprise Constant Fraction Discriminators ("CFDs"). However, according to less preferred embodiments one or more of the discriminators may comprise another type of discriminator such as a leading edge discriminator or a zero crossing discriminator.

The output from the ASIC 5 is then preferably processed by a processor 6.

According to an embodiment of the present invention an Application Specific Integrated Circuit ("ASIC") 5 is preferably used in the detector system of a Time of Flight mass spectrometer. The ASIC 5 preferably comprises approx. 1000 input channels, each channel having its own amplifier, signal conditioning element and TDC incorporated into the ASIC 5. Such a detector is preferably capable of delivering $10^9$ events/second to a downstream processor 6.

To achieve the greatest possible mass resolution for a Time of Flight mass spectrometer requires very high timing precision. Modern Time of Flight mass spectrometers are capable of achieving resolutions of 100,000 (FWHM) or more and require timing precision of better than 100 picoseconds.

A microchannel plate (MCP) is ideally suited to convert ions to electrons due to its high gain (typically 1000 per plate) and fast rise time (typically a few 100's of picoseconds) and hence is particularly suited for Time of Flight detection.

In a known double or chevron arrangement two MCPs are employed to provide coulombic gains of $10^6$ or more before digitization. Such an arrangement is effective to amplify signals up to an incoming ion rate of about $10^7$ events/second. However, at higher ion arrival rates the double or chevron MCP arrangement becomes non-linear as it is no longer possible to sustain the strip current required to maintain its gain.

At low or moderate count rates $<10^7$ events/second enough current is supplied to the plate to recharge the channels between successive ion strikes, but at higher count rates insufficient current is available to replenish the charge and the overall gain of the chevron starts to collapse. This is because the high resistance of the MCP channels limit the current available at the typical supply voltage of around 1 kV/plate.

The ion detector according to the preferred embodiment preferably comprises a single MCP 1 in combination with a photodiode array 4 and represents an alternative ion to electron converter. Advantageously, the preferred ion detector can sustain a coulombic gain of $>10^5$ at very high incoming ion rates of $10^9$ events/second.

The single MCP 1 which is preferably used according to an embodiment of the present invention may comprise a circular plate 5-150 mm in diameter with a honeycombed array of circular holes a few microns (typically 3-12 μm) in diameter. The holes preferably run at an angle of a few degrees to the axis of the plate which is preferably around 0.5 mm thick. A voltage difference of 1000V is preferably maintained along the length of the channels, with each one acting like a microscopic electron multiplier of gain around 1000.

According to less preferred embodiments if more gain is required then two such MCP plates may be placed in series with the orientation of the holes set in a chevron arrangement. This orientation prevents a phenomenon familiar to those skilled in the art known as ion feedback which can reduce detector gain and allows gains in excess of to $10^6$ for each channel.

Due to the resistive nature of the MCP after an ion strikes the inside of a particular channel it takes a finite time to replenish the depleted charge supplied during the electron multiplication process. This charge depletion is greatest in the second of the two plates of a chevron arrangement because the nature of the amplification process means that the electron current grows progressively along the length of the channels.

Although two MCPs could be used according to a less preferred embodiment, an advantage of the preferred embodiment is that the ion detector can and preferably is implemented using a single MCP 1.

In a single channel MCP a distribution of gains (pulse heights) are observed at the output. This Pulse Height Distribution ("PHD") follows a Furry distribution (which is the discrete analogue of the Exponential distribution).

In the case of a chevron or double MCP arrangement the channels of the second plate have the highest electron density and therefore supply most of the charge. The charge density is so high that it is limited by space charge effects causing gain saturation of the channel. This has the advantage in that it results in a relatively narrow distribution of output pulse heights.

Figure 3:
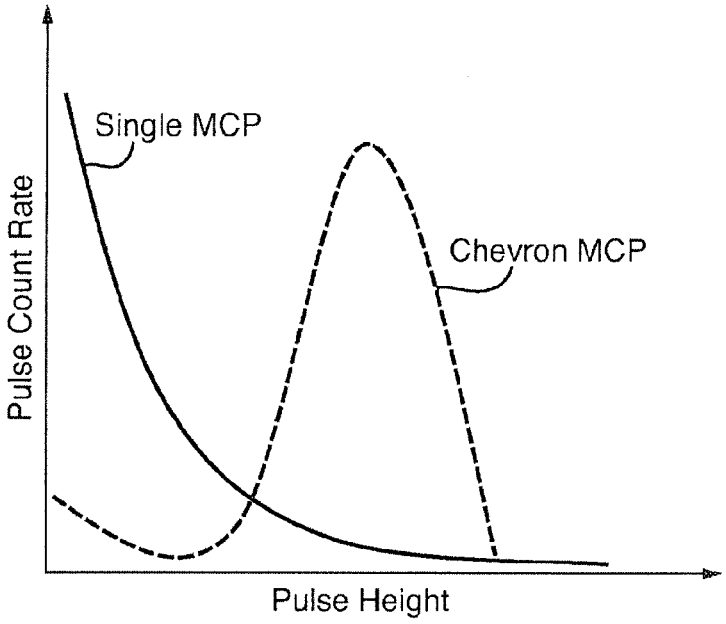
FIG. 3 shows pulse height distributions for single and chevron MCP arrangements.

Typical PHDs for both single and chevron MCPs are shown in FIG. 3. If a simple threshold method is used to trigger the TDC then it will be understood that the narrower the PHD the less variation or jitter there will be in the resulting arrival time measurement of the ion. Variation in measured times due to variation in pulse heights is known as time walk.

Each pixel or photodiode in the photodiode array according to the preferred embodiment preferably has a gain of around 1000. As a result, the photodiode array 4 according to the preferred embodiment preferably provides a similar amplification level similar to that of a second plate in a double MCP or chevron arrangement i.e. the total gain is around $10^6$.

A particularly advantageous feature of the present invention is that the photodiodes 4 in the photodiode array under gain conditions of 1000 do not run into space charge saturation (in contrast to a chevron or double MCP arrangement).

The PHD of a single MCP-photodiode array arrangement according to an embodiment of the present invention follows a Furry distribution as described above for a single MCP and as shown in FIG. 3. The Furry distribution gives a greater variation in measured ion arrival times (so called time walk) with a simple edge detection threshold trigger. This variation is preferably minimised using a discriminator circuit. According to the preferred embodiment a Constant Fraction Discriminator ("CFD") is preferably used to minimize the time walk.

Figure 4A:
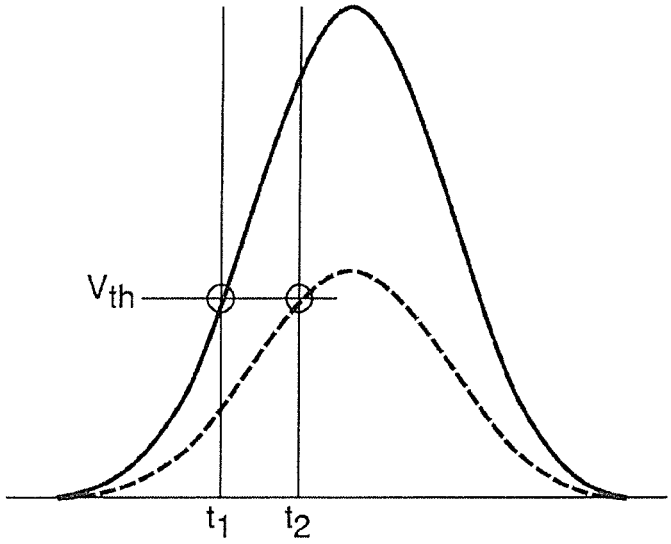
FIG. 4A shows how a simple threshold trigger can result in time walk and FIG. 4B shows how triggering with a Constant Fraction Discriminator ("CFD") can significantly reduce time walk.
Figure 4B:
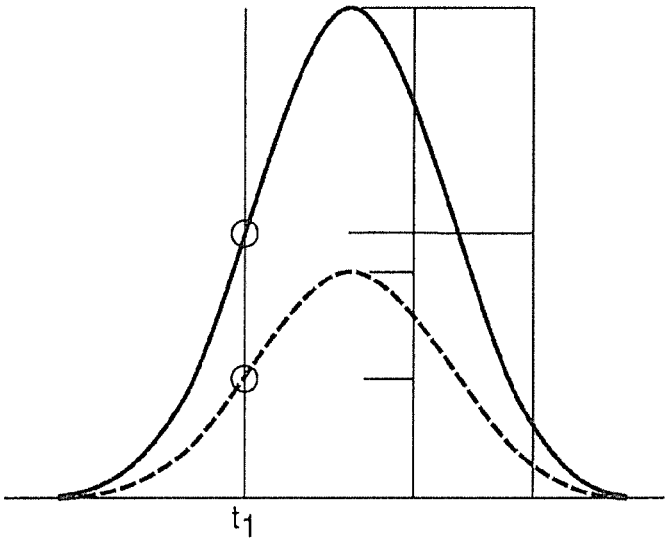

The principle of operation of a CFD device will be briefly described with reference to FIGS. 4A and 4B. FIG. 4A shows how triggering with a simple threshold trigger level $V_{th}$ can result in time walk. By way of contrast, FIG. 4B shows how triggering with a Constant Fraction Discriminator ("CFD") can significantly reduce the effect of time walk.

According to the preferred embodiment a front end discriminator for every channel is preferably included into the ASIC 5 for the detector to overcome the limitation caused by using only a single MCP to convert ions to electrons. The discriminators for every channel preferably comprise Constant Fraction Discriminators.

Normally photodiodes are designed to amplify light signals rather than electrons such as are output from the MCP 1. However, it is possible to amplify the signal using a method of direct detection of the electron cloud emitted by a MCP 1 on to a photodiode array 4. Direct detection works by the creation of electron-hole pairs in the photodiodes 4 provided that the kinetic energy of the incoming electrons 3 is sufficiently high.

Figure 5:
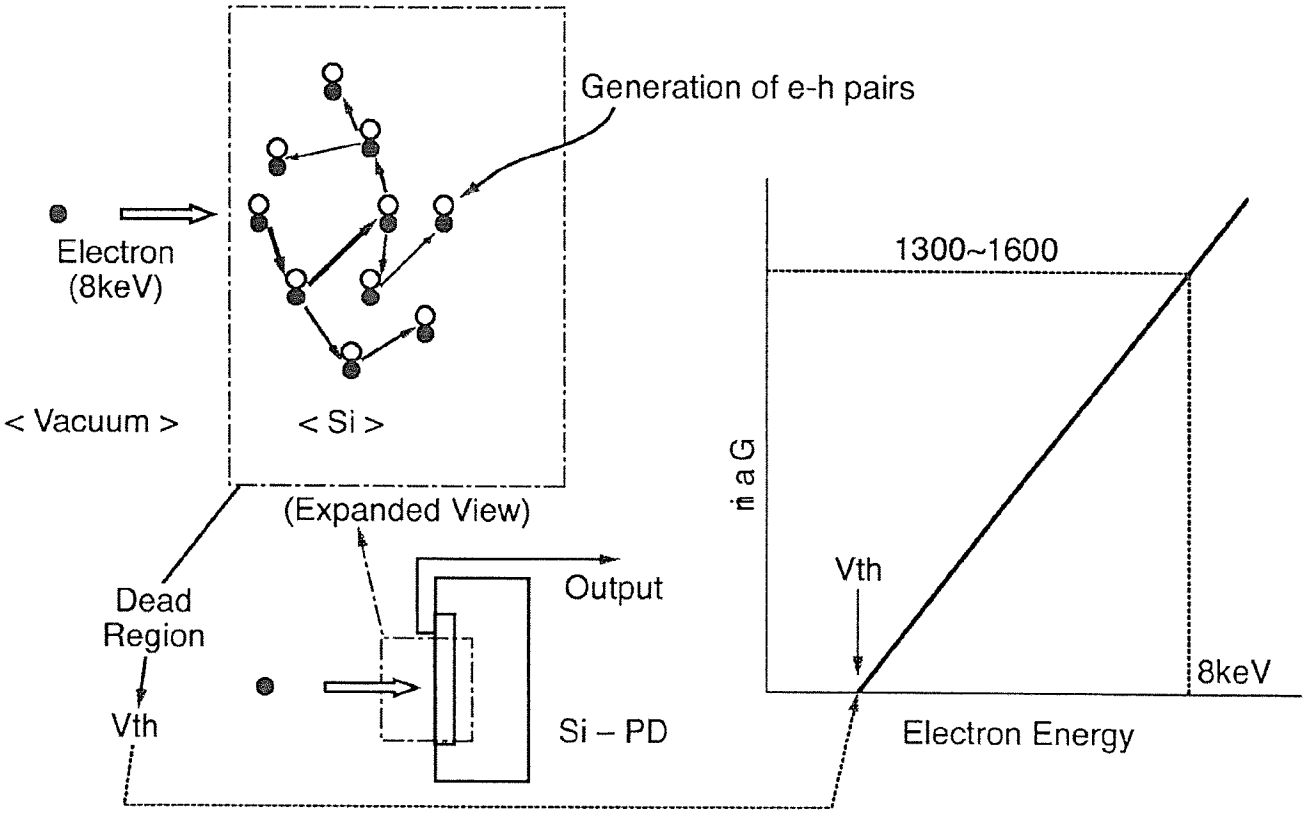
FIG. 5 shows the concept of direct detection of electrons using a silicon photodiode ("Si-PD") according to an embodiment of the present invention.

FIG. 5 shows the concept of direct detection of electrons 3 using a silicon photodiode 4 and the corresponding gain characteristic.

It is desirable to accelerate the electrons 3 to around 8 keV so they can produce sufficient electron-hole pairs in the silicon photodiode 4 for subsequent amplification levels of around 1000. According to the preferred embodiment electrons 3 emitted from the MCP 1 are preferably accelerated to ≥8 keV.

According to another embodiment the output electron cloud emitted from a single MCP 1 may be converted into light or photons using a fast scintillation device. The fast scintillation device preferably converts the electrons 3 emitted from the MCP 1 into photons. The photons may then be directly detected by the photodiode array 4.

A lens or fiber optic plate may be used to retain the pixilated information from the MCP 1 and to illuminate a single photodiode in a photodiode array per ion strike.

Two specific preferred embodiments will now be described with reference to FIGS. 6 and 7.

Figure 6:
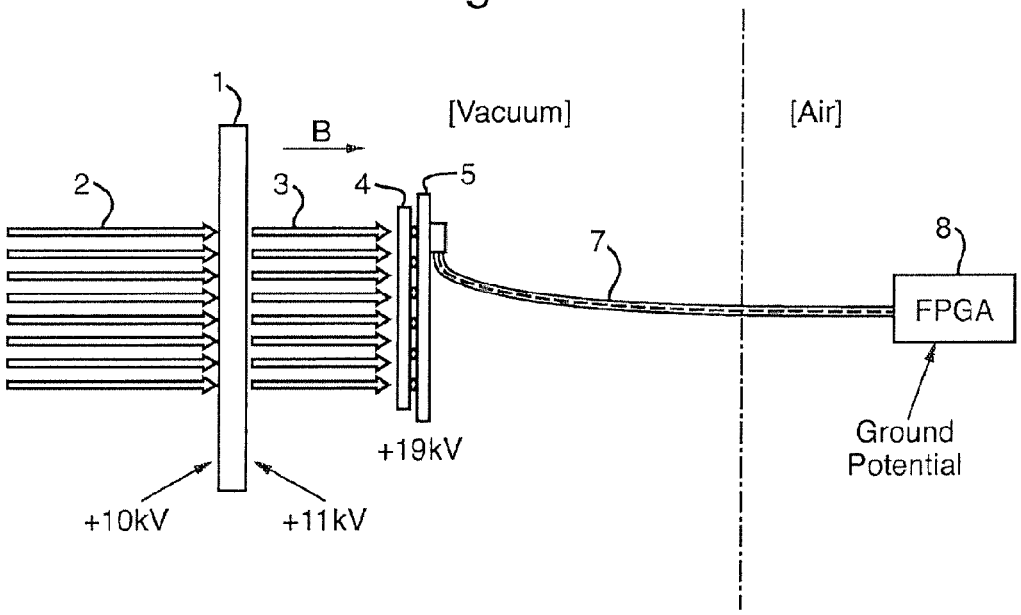
FIG. 6 shows a multiple channel scheme for negative ion detection employing direct detection of electrons in a photodiode array according to an embodiment of the present invention.

According to a first preferred embodiment ions 2 arriving at an ion detector after having traveled through a time of flight region of a Time of Flight mass spectrometer are preferably arranged to strike a single MCP 1 producing secondary electrons 3 as shown in FIG. 6. The voltage applied across the MCP 1 is preferably around 1 kV producing a coulombic gain of around 1000.

As one ion can only strike the surface of one channel of the MCP 1, the amplified electron cloud preferably emerges from a single channel of the MCP 1 with a spatial distribution of the order of the channel diameter itself (typically 2-12 μm). The spatial coordinate of the initial ion strike is therefore conserved and the output electron cloud 3 is preferably not allowed to expand beyond one pixel size as it travels from the MCP 1 towards a photodiode array 4. This can be accomplished by placing the photodiode array 4 in close proximity to the MCP 1 and/or by applying a magnetic field B in the direction as shown in FIG. 6 to collimate the electrons 3.

The potential difference between the output side of the MCP 1 and the photodiode array 4 is preferably around 8 keV which is preferably sufficient to produce enough electron-hole pairs to give the required gain of 1000 for this stage. The total gain is preferably $10^6$ for each of the 1000 pixels and a signal of this size is preferably large enough for further conditioning in an ASIC 5. The ASIC 5 preferably comprises a CFD circuit followed by a TDC for the output from each photodiode 4. Alternatively, the signal output from the photodiode array 4 may not pass through a discriminator circuit and may be directly fed into a TDC if less timing precision is required.

The data stream from the ASIC 5 may be passed down an optical fiber data link 7 which preferably serves the dual purpose of decoupling the detector system from the high voltage necessary for operation of this device and passing the digital data to a downstream Field Programmable Gate Array ("FPGA") 8 which is preferably maintained at ground potential. Greater description of the voltages required for operation of the detector will be given below in relation to a second preferred embodiment.

Mass spectrometers are generally required to analyse both positive and negatively charged ions. In order to achieve this in an orthogonal acceleration Time of Right mass analyser it is necessary to raise the front surface of the first component of the detection system to a high voltage, typically −10 kV for positive ions and +10 kV for negative ions. If the first component of the detection system is an electron multiplier such as a MCP 1 as in the preferred embodiment then its rear surface should be more positive than its front surface by about 1 kV to attract the amplifying electrons. In the case of the first preferred embodiment a further 8 kV is required between the rear of the MCP 1 and the photodiode array 4 in order to generate the electron-hole pairs for the coulombic gain of 1000 required for this stage of the detector. In negative ion operation this gives a total of 19 kV with respect to ground potential as shown in FIG. 6. Floating the photodiode array 4 and sensitive ASIC 5 to such high potentials requires careful design to prevent electrical arcs and discharges which would otherwise cause damage to the components. The signal from the ASIC 5 is preferably decoupled back to ground by an optical fiber data link 7 before signal processing by a FPGA 8 or similar device.

Figure 7:
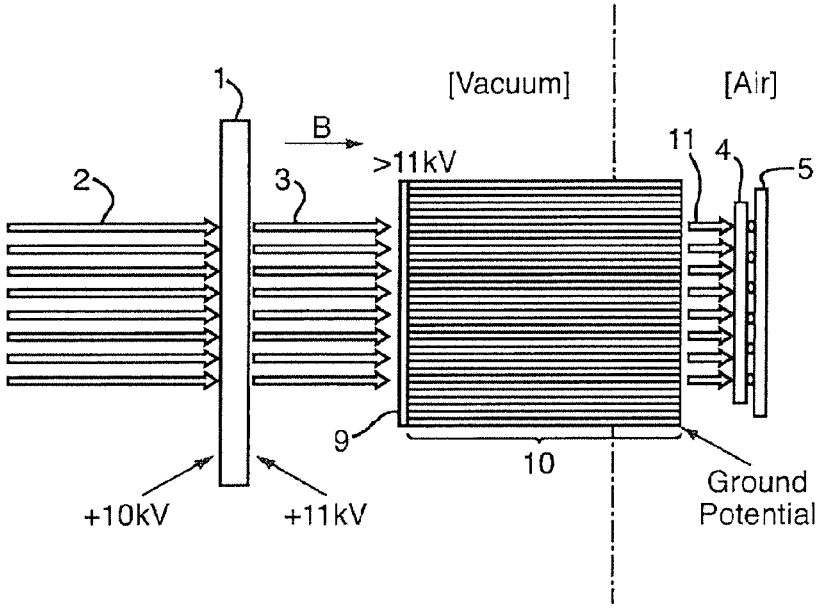
FIG. 7 shows a multiple channel scheme for negative ion detection employing a scintillator and light guide which directs photons onto a photodiode array according to another embodiment of the present invention.

According to a second preferred embodiment the optical decoupling step may be achieved before the sensitive electronic components of the photodiode array 4 and ASIC 5 thereby allowing the photodiode array 4 and ASIC 5 to be operated at ground potential in a manner as shown in FIG. 7.

According to the second preferred embodiment the electron cloud 3 emitted from the output of the MCP 1 is preferably accelerated onto a scintillator 9 which preferably emits photons that are ultimately guided onto a photodiode array 4 and are amplified in a more conventional manner.

A lens or a fiber optic plate 10 may optionally be used to retain the spatial information of the initial ion strike. The scintillator 9 is preferably as fast as possible to avoid overall degradation of the rise time or bandwidth of the whole detector system.

Photons 11 are preferably emitted from the rear face of the lens or fibre optic plate 10 and the photons 11 are preferably directly detected by the photodiode array 4. The photodiode array 4 is preferably connected to an ASIC 5 which preferably comprises an array of Constant Fraction Discriminators and an array of TDCs.

Although the present invention has been described with reference to preferred embodiments, it will be understood by those skilled in the art that various changes in form and detail may be made without departing from the scope of the invention as set forth in the accompanying claims.

The invention claimed is:

1. An ion detector for detecting ions from a Time of Flight mass spectrometer and measuring arrival times of the ions, said ion detector comprising:

a first device arranged and adapted to receive ions and output electrons;

a converter arranged and adapted to receive said electrons and output photons;

an array of photodiodes arranged and adapted to detect said photons output from said converter or other photons, each photodiode having an output, wherein a separate discriminator is connected to the output from each photodiode;

an array of Time to Digital Converters wherein the output from each photodiode is connected to a separate Time to Digital Converter; and a fibre optic plate, lens or photon guide arranged between said converter and said array of photodiodes, wherein said fibre optic plate, lens or photon guide transmits or guides said photons or other photons towards said array of photodiodes and is arranged to retain spatial information of each ion strike.

2. An ion detector as claimed in claim 1, wherein said first device comprises a single microchannel plate.

3. An ion detector as claimed in claim 1, wherein said array of photodiodes comprises at least 10, 20, 30, 40, 50, 60, 70, 80, 90, 100, 150, 200, 250, 300, 350, 400, 450, 500, 550, 600, 650, 700, 750, 800, 850, 900, 950, 1000, 1100, 1200, 1300, 1400, 1500, 1600, 1700, 1800, 1900 or 2000 photodiodes.

4. An ion detector as claimed in claim 1, wherein said photodiodes comprise silicon photodiodes.

5. An ion detector as claimed in claim 1, wherein said photodiodes are arranged and adapted to create electron-hole pairs.

6. An ion detector as claimed in claim 1, wherein said array of Time to Digital Converters comprises at least 10, 20, 30, 40, 50, 60, 70, 80, 90, 100, 150, 200, 250, 300, 350, 400, 450, 500, 550, 600, 650, 700, 750, 800, 850, 900, 950, 1000, 1100, 1200, 1300, 1400, 1500, 1600, 1700, 1800, 1900 or 2000 Time to Digital Converters.

7. An ion detector as claimed in claim 1, wherein said discriminators or at least some of said discriminators comprise Constant Fraction Discriminators ("CFDs").

8. An ion detector as claimed in claim 1, wherein said discriminators or at least some of said discriminators comprise leading edge or zero crossing discriminators.

9. An ion detector as claimed in claim 1, wherein said array of Time to Digital Converters and optionally a plurality of discriminators are provided on an Application Specific Integrated Circuit ("ASIC").

10. An ion detector as claimed in claim 9, wherein said Application Specific Integrated Circuit is maintained substantially at ground or zero potential.

11. An ion detector as claimed in claim 1, wherein said converter comprises a scintillator.

12. An ion detector as claimed in claim 1, wherein said converter is arranged between said first device and said array of photodiodes.

13. An ion detector as claimed in claim 1, further comprising a device arranged and adapted to provide a magnetic or electric field which directs said electrons onto said converter.

14. An ion detector as claimed in claim 1, wherein said ion detector is arranged and adapted to process $\geq 10^7$, $\geq 10^8$ or $\geq 10^9$ events per second.

15. A Time of Flight mass analyser comprising an ion detector as claimed in claim 1.

16. A method of detecting ions from a Time of Flight mass spectrometer and measuring arrival times of the ions comprising:

receiving ions and outputting electrons;

using a converter to receive said electrons and output photons;

detecting said photons output from said converter or other photons using an array of photodiodes, each photodiode having an output;

passing the output from each photodiode to a separate discriminator and Time to Digital Converter; and transmitting or guiding said photons output from said converter or other photons towards the array of photodiodes with a fibre optic plate, lens or photon guide arranged between said converter and said array of photodiodes, and arranged to retain spatial information of each ion strike.

17. An ion detector as claimed in claim 1, wherein said array of photodiodes is further arranged and adapted to stop each photodiode from experiencing space charge saturation.

18. An ion detector as claimed in claim 17, wherein the photodiodes in said array each have a gain of up to 1000.

19. An ion detector as claimed in claim 17, wherein each photodiode is stopped from experiencing space charge saturation without an optical filter.

20. An ion detector as claimed in claim 1, wherein said separate discriminators connected to the output from each photodiode are arranged and adapted to reduce a variation in the arrival times of the ions measured by the detector.

21. An ion detector as claimed in claim 1, wherein said first device and said converter are disposed within a vacuum chamber, said array of photodiodes is disposed outside of said vacuum chamber and said fibre optic plate, lens or photon guide is arranged and adapted to transmit or guide said photons from said converter disposed within the vacuum chamber to said array of photodiodes disposed outside of the vacuum chamber.

22. A method of detecting ions from a Time of Flight mass spectrometer and measuring arrival times of the ions as claimed in claim 16, wherein a first device and said converter are disposed within a vacuum chamber and said array of photodiodes is disposed outside of said vacuum chamber, said method further comprising:

receiving ions and outputting electrons comprises receiving ions and outputting electrons with the first device, and transmitting or guiding said photons output from said converter or other photons towards the array of photodiodes comprises transmitting or guiding said photons from said converter disposed within the vacuum chamber to said array of photodiodes disposed outside of the vacuum chamber.

* * * * *